US005799620A

United States Patent [19]

Cleer, Jr. et al.

[11] Patent Number: 5,799,620

[45] Date of Patent: Sep. 1, 1998

[54] DIRECT CONTACT FLUID HEATING DEVICE

[76] Inventors: Clarence W. Cleer, Jr., 98 S. Fraley St.; Brett Allen Cleer, 505 Tionesta Ave.; Mark Cleer, Star Rte., all of Kane, Pa. 16735; Patrick I. Branch, 461 Goldsmith Rd., Pittsburgh, Pa. 15237

[21] Appl. No.: 665,311

[22] Filed: Jun. 17, 1996

[51] Int. Cl.[6] ..... F22B 1/18

[52] U.S. Cl. ..... 122/31.2; 122/31.1

[58] Field of Search ..... 110/254; 122/31.1, 122/31.2, 39, 40, 28, 33

[56] References Cited

U.S. PATENT DOCUMENTS

| | | | |
|---|---|---|---|
| 3,736,886 | 6/1973 | Menigat | 110/254 |
| 3,897,194 | 7/1975 | Von Wiesenthal | 122/33 |
| 4,278,050 | 7/1981 | Kime | 122/40 |
| 4,287,138 | 9/1981 | Buckner | 261/128 |
| 4,353,217 | 10/1982 | Nishioka et al. | 60/693 |
| 4,694,783 | 9/1987 | Cleer . | |
| 5,305,735 | 4/1994 | Welden | 122/31.1 |

OTHER PUBLICATIONS

Heating Piping Air Conditioning Magazine, Aug., 1991 "Gas–Fired Boilers Replace District Steam", Faino and Cleer.

Energy and Technology for Industry, Winter, 1995 "Quik-Water Heating System: Nearly 100% Efficient".

Advertisement "The Revolutionary Quantum Leap Boiler by Dunkirk", Approx. Apr. Issue of Computer Magazine.

*Primary Examiner*—Teresa J. Walberg
*Assistant Examiner*—Gregory Wilson
*Attorney, Agent, or Firm*—Nixon & Vanderhye PC

[57] ABSTRACT

High efficiency heat transfer from hot gases produced by combustion of fuel and oxygen in a burner to usably heat is provided in a simple and effective manner. A burner within a water-tight casing is mounted submerged within a pool of condensate within a boiler casing. Hot gases from the burner are passed into direct heat exchange contact with condensate in the pool, and then flow in a turbulent manner into contact with a wet solid material heat exchange surface, such as pieces of limestone mounted on a perforated plate above the pool of liquid. The hot gases give up heat directly to the liquid wetting the heat transfer surface, and then are exhausted out the top of the boiler, passing through a secondary heat exchanger. Condensate is drained from the boiler to prevent excessive buildup. Liquid from the pool is circulated through a primary heat exchanger into heat exchange relationship with a heat exchange fluid, and then reintroduced into the boiler casing above the heat transfer surface (e.g. by spray nozzles), wetting the heat transfer surface.

26 Claims, 3 Drawing Sheets

DIRECT CONTACT FLUID HEATING DEVICE

BACKGROUND AND SUMMARY OF THE INVENTION

U.S. Pat. No. 4,694,783 recognizes that effective heat transfer can be provided by bringing combustion off gases into direct contact with liquid, such as condensate, and useful heat recovered from that liquid. The system disclosed in that patent also provides for improved venting from multiple boilers. However in that patent the majority of the heat recovery was obtained utilizing conventional heat recovery devices. It has now been found that some of the basic concepts from the 4,694,783 patent may be applied utilizing other technology in a synergistic manner so as to recover useful heat from the combustion of fuel with oxygen in a very high efficiency, cost-effective manner. According to the present invention sufficient heat transfer is provided by the direct exposure of combustion gases to the surface area of liquid so as to effectively recover the vast majority of the heat from the gases in a highly efficient and economical manner.

According to one aspect of the present invention a method of efficiently recovering heat from gases exiting a burner is provided, comprising the steps of: (a) Effecting combustion of fuel and oxygen (e.g. in air) in a burner to produce hot gases. (b) Directing the hot gases into direct contact with a pool of liquid so as to effect heat exchange between the hot gases and the liquid in the pool. (c) Causing the hot gases to flow in a turbulent manner into contact with a solid material heat transfer surface wet with liquid, so that heat from the turbulent flow of hot gases is transferred directly to the liquid wetting the solid material heat transfer surface. (d) Ultimately passing the gases, after steps (b) and (c), to exhaust. And, (e) passing the liquid heated during the practice of steps (b) and (c) into heat exchange relationship with a heat exchange fluid which recovers usable heat from the liquid.

In the practice of the method of the invention preferably step (c) is simultaneously practiced to neutralize the pH of the liquid wetting the heat transfer surface. The liquid utilized in the practice of steps (b) and (c) is preferably substantially exclusively condensate formed by the condensation of vapor in the hot gases from step (a). Preferably the liquid heated during the practice of step (c) is caused to flow into the pool of liquid, and step (e) is practiced by causing the liquid from the pool of liquid to flow into heat exchange relationship with the heat exchange fluid. The heat transfer surface may be wetted by spraying liquid from step (e) onto the heat transfer surface after the liquid has passed into heat exchange relationship with the heat exchange fluid. After the practice of steps (b) and (c), and before step (d), the gas may be passed through a secondary heat exchanger in heat transfer relationship with a second heat transfer fluid.

Formed condensate is removed from the pool so that the pool stays within a predetermined size range, e.g. by providing a substantially open drain. Also, the hot gases are introduced in step (b) substantially completely within the pool liquid, or alternatively at least the majority of the hot gases are brought into contact with the pool from above the pool. Step (c) may be practiced at least in part by creating a partial vacuum which causes the hot gases to flow from the burner through the heat transfer surface ultimately to exhaust.

According to another aspect of the present invention there is provided a method of transforming the heat of combustion from a burner into useful heat comprising the steps of: (a) Effecting combustion of fuel and oxygen in a burner to produce hot gases. (b) Causing the hot gases to flow in a turbulent manner into contact with a solid material heat transfer surface wet with liquid, so that heat from the turbulent flow of hot gases is transferred directly to the liquid wetting the solid heat transfer surface, while simultaneously neutralizing the pH of the liquid wetting the solid material heat transfer surface. (c) Ultimately passing the gases, after step (b), to exhaust. And, (d) passing the liquid heated during the practice of step (b) into heat exchange relationship with a heat exchange fluid which recovers usable heat from the liquid. In the practice of the method of the invention preferably step (b) is practiced by passing the hot gases into contact with porous solid limestone as the heat transfer surface.

According to another aspect of the present invention a high efficiency boiler is provided. It comprises the following components: A burner for combusting fuel with oxygen to produce hot gases. A substantially water-tight burner casing surrounding the burner, and an exhaust conduit from the water-tight casing, the exhaust conduit having an exhaust opening. A boiler casing having a top and bottom, the boiler casing substantially water tight and substantially air-tight. Liquid forming a pool disposed within the boiler casing having a level spaced from the bottom of the boiler casing. The burner casing disposed within the boiler casing, substantially submerged in the liquid, and the exhaust conduit opening positioned to direct the hot gases from the burner into direct contact with the liquid. And, means for circulating liquid from the pool of liquid into heat exchange relationship with a heat exchange fluid so as to recover useful heat from the liquid.

Preferably a solid material wet heat transfer surface is mounted in the boiler casing above the liquid level and positioned so that turbulent hot gases from the exhaust conduit pass through the heat transfer surface into direct contact with liquid wetting the solid material heat transfer surface. At least one spray nozzle may be disposed in the boiler casing above the solid heat transfer surface for spraying liquid onto the heat transfer surface to wet it. The means for circulating liquid from the pool into heat exchange relationship with a heat transfer fluid may comprise a conduit for connecting the liquid to the at least one spray nozzle after the liquid has been brought into heat exchange relationship with a heat transfer fluid.

An exhaust blower and a secondary heat exchanger may be mounted adjacent the top of the boiler casing for exhausting gases from the burner cooled within the boiler casing and passing those gases into heat exchange relationship with a second heat exchange fluid. The solid heat transfer surface preferably includes pieces of limestone. The liquid in the boiler casing is substantially exclusively condensate formed by condensation of vapors in the hot gases; and there desirably is an open drain establishing the liquid level and for draining excess condensate from the boiler casing. The exhaust opening may be disposed substantially completely below the liquid level; or, alternatively, the exhaust opening may comprise a plurality of exhaust openings, at least the majority of the exhaust openings disposed above the liquid level.

According to another aspect of the present invention a high efficiency boiler is provided comprising: A burner for combusting fuel and oxygen to produce hot gases. An exhaust conduit including an exhaust opening for transmitting hot gases from the burner. A boiler casing including a top and a bottom, the exhaust conduit opening opening into the boiler casing. A wet heat transfer surface disposed in the boiler casing and substantially dividing the boiler casing into first and second volumes, the exhaust conduit opening into the first volume. Means for wetting the heat transfer surface so that hot gases from the exhaust opening come into direct contact with liquid on the heat transfer surface. Means for circulating liquid heated by hot gases within the boiler casing into heat exchange relationship with a heat exchange fluid exterior of the boiler casing so as to recover useful heat from the liquid. And, means for causing the hot gases from the exhaust conduit to flow in a turbulent manner through the heat transfer surface from the first volume to the second volume. Preferably the heat transfer surface extends substantially horizontally within the boiler casing, the first volume below the heat transfer surface and the second volume above the heat transfer surface. The heat transfer surface preferably includes limestone, e.g. pieces of limestone mounted on a perforated plate.

It is the primary object of the present invention to provide for the high efficiency recovery of heat from combustion gases in an economical manner. This and other objects of the invention will become clear from an inspection of the detailed description of the invention and from the appended claims.

DETAILED DESCRIPTION OF THE DRAWINGS

Figure 1:
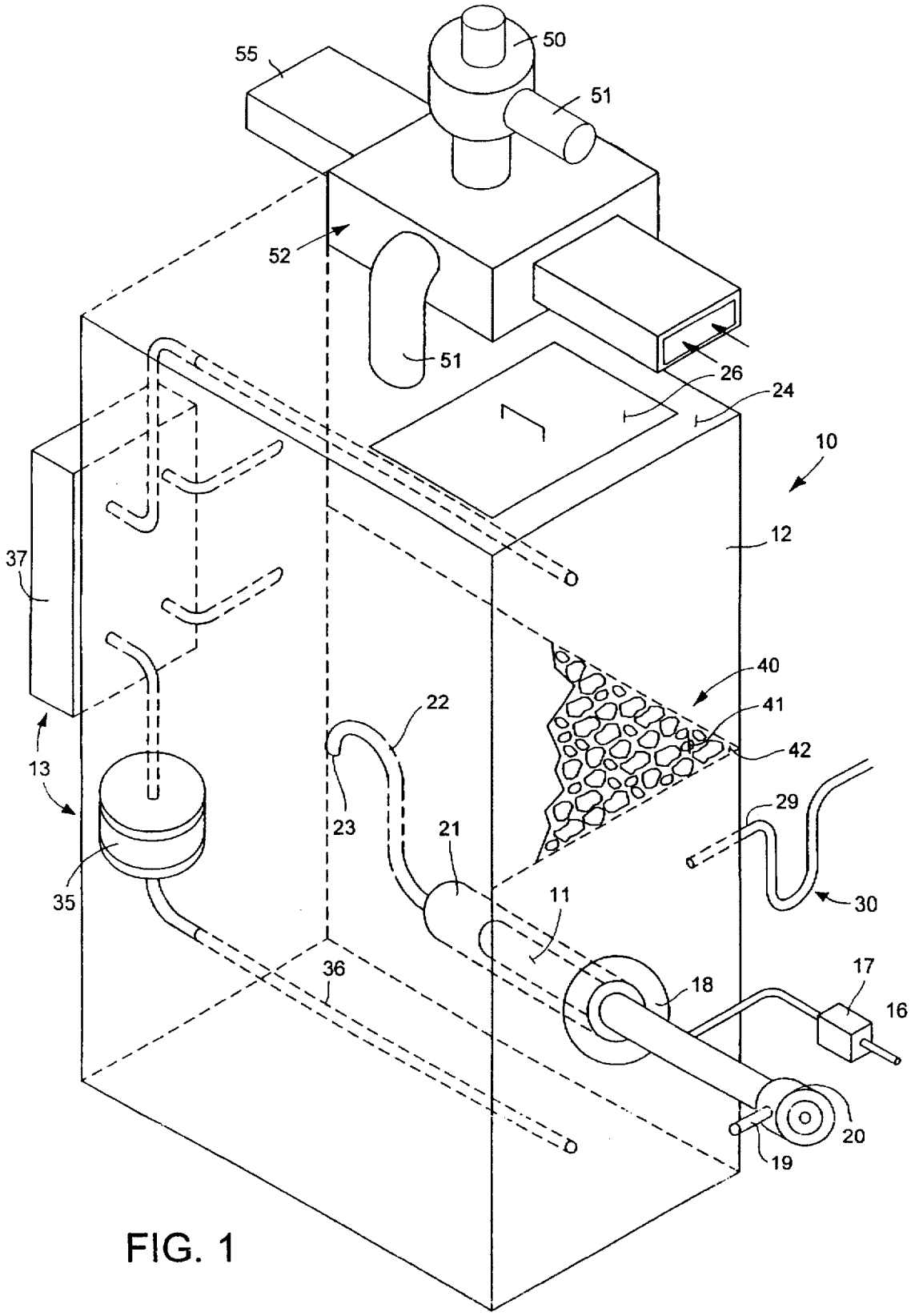
FIG. 1 is a top schematic perspective view of an exemplary high efficiency boiler according to the present invention.
Figure 2:
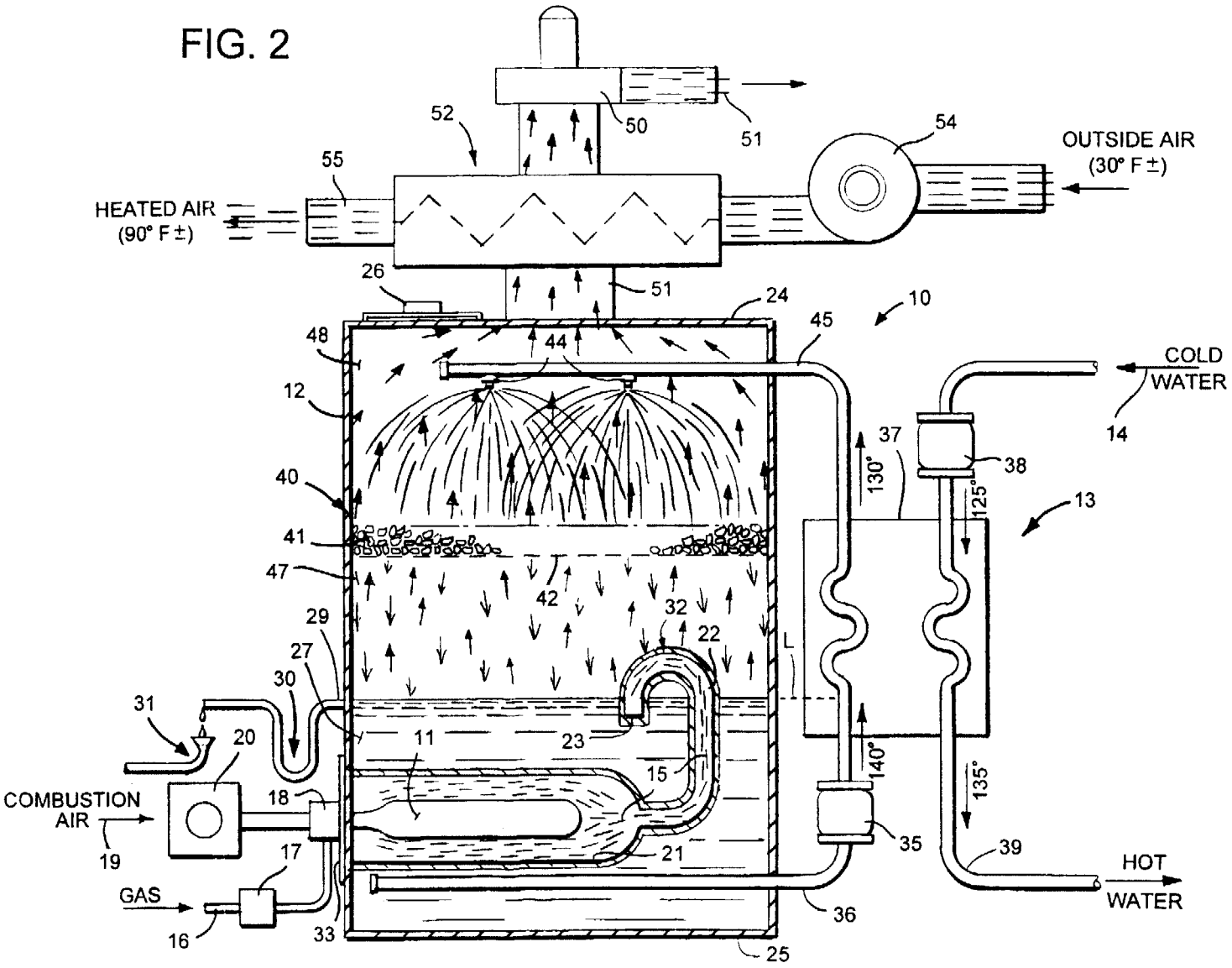
FIG. 2 is a side detail view, partly in cross-section and partly in elevation, of the boiler of FIG. 1.

An exemplary high efficiency boiler according to the present invention is shown generally by reference numeral 10 in FIGS. 1 and 2. The boiler includes a burner 11 of conventional construction, a boiler casing 12, and means shown generally by reference numeral 13 for circulating liquid from the boiler casing 12 into heat exchange relationship with a first heat exchange fluid 14 so as to recover useful heat from the liquid from the boiler casing 12.

The burner 11 combusts fuel, such as methane, propane, hydrogen, fuel oil, or the like with oxygen, typically from either preheated or ambient air, to produce hot gases. The hot gases are shown schematically at 15 in FIG. 2. In the exemplary embodiment illustrated in the drawings, methane passes in conduit 16 through a gas regulator 17 to the inlet 18 to the burner 11, being combined with combustion air 19 passing through the filter 20 also to the inlet 18 to the burner 11.

In the preferred embodiment the burner 11 is mounted in a substantially water-tight burner casing 21, e.g. made of stainless steel or like corrosion resistant material that is either seamless, or with gasketed seams. No unusual efforts need be taken to make the burner casing 21 substantially water-tight since normal gasketing or seamless construction will preclude passage of liquid into the interior of the burner casing, and even if a small amount does enter the casing it will be vaporized quickly when the burner 11 operates.

Extending from the burner casing 21 is an exhaust conduit 22 having an exhaust opening (or a plurality of openings) 23.

The boiler casing 12 has a top 24 and a bottom 25. The boiler casing 24 is itself substantially water and air-tight, since during use it contains a liquid at the bottom thereof, and it is desirable to maintain all gases within the casing 24 until properly exhausted. The casing 24 may also be made out of stainless steel with all seams sealed by appropriate gaskets. A sealed inspection opening 26 may be provided at the top 24.

After installation of the boiler 10 and during use thereof, liquid 27 is disposed within the boiler casing 12 establishing a level L spaced from the bottom 25 of the boiler casing 12. The level L may be maintained by any suitable conventional means which include conventional sensors of all types, automatic valve controls for conduits, or the like. In the embodiment illustrated the level L is maintained by a simple drain 29 disposed at the level L, and which has a U-shaped trap 30 formed therein. The trap 30 prevents the passage of gas from the casing 12 through the drain 29. The liquid being drained may be sewered into sewer 31, or treated (if necessary) and put to other uses.

The liquid 27 is normally substantially exclusively condensate formed by condensation of vapors in the hot gases 15. Because the condensate continues to build up after a level L has been established (which level may initially be established at start-up by tap water or distilled water) the drain 29 is desirable to ensure that the liquid pool 27 stays within a predetermined size (volume and level) range.

In the embodiment illustrated in FIGS. 1 and 2, the opening 23 from the exhaust conduit 22 is below the level L of the liquid pool 27. This is desirable in order to prevent undesired release of gases if the unit 10 is connected up with a plurality of other units, the liquid pool 27 providing a liquid seal preventing gas from exhausting through the opening 23, as generally disclosed in U.S. Pat. No. 4,694,783 (the disclosure of which is hereby incorporated by reference herein). To prevent liquid from passing from the pool 27 into the conduit 22, and back to the burner casing 21, when the opening 23 is immersed in the liquid pool 27, the conduit 22 is arched as indicated at 32 in FIG. 2, having a top portion located well above the level L.

In the preferred embodiment illustrated in FIG. 2 it will also be seen that the burner casing 21 is at least partially immersed in the liquid pool 27, and preferably completely immersed, e.g. extending substantially horizontally from the side wall of the boiler casing 12, e.g. mounted by a mounting flange 33, so that the uppermost portion of the casing 21 is below the level L. This provides good heat transfer of heat from the burner 11 to the liquid in the pool 27 since the burner casing 21 is of heat conductive material, and the hot gases 15 issuing from the exhaust opening 23 also directly contact the pool of liquid 27 so as to effect direct heat exchange between the hot gases 15 and the liquid in the pool 27.

The means 13 for circulating liquid from the pool 27 into a heat exchange relationship with the first heat exchange fluid 14 (e.g. water is preferred although air or other heat exchange gases, liquids, or slurries may be utilized) may be very simple. For example in the embodiment illustrated in FIG. 2 a simple conventional circulation pump 35 is connected to an inlet conduit 36 (which may have a single inlet opening at the end thereof or a plurality of openings along its length and may be made of copper) which takes the condensate from the pool 27 preferably above the bottom 25 and below the casing 21 and pumps it into a conventional simple plate heat exchanger 37 (e.g. of stainless steel). In the heat exchanger 37 the hot liquid from the conduit 36 is brought into heat exchange relationship with the "cold" water 14 or other heat exchange fluid which is circulated via pump 38 through the heat exchanger 37. The heated heat exchange fluid in conduit 39 extending from the heat exchanger 37 may then be used for space heating, domestic hot water, snow melting, swimming pool heating, or almost any other desired use.

While the circulating means 13 schematically illustrated in FIGS. 1 and 2 is a desirable simple arrangement, it is to be understood that any suitable conventional circulating means may be utilized. For example circulation may be by the thermosiphonic effect, or utilizing any type of powered circulating device or gravity flow. While it is preferred that the heat exchanger be an indirect heat exchanger such as a plate heat exchanger 37 (or any other type of conventional heat exchanger) at least partial direct heat exchange may be provided in some circumstances especially if the heat exchange fluid 14 is gaseous or a gel or slurry rather than liquid, and any desired automatic or manual controls may be provided for the components, for example diverting the hot liquid from the pool 27 to a number of different uses either simultaneously or alternatively.

While the immersion of the burner casing 21 in the condensate pool 27 and the passage of the hot gases 15 from the conduit 22 into direct heat exchange contact with the condensate in the pool 27 do provide very effective heat transfer, it is desirable in order to have a high efficiency unit 10 to effect further direct heat transfer from the hot gases to liquid. This is preferably further facilitated by providing a solid material wet heat transfer surface, shown schematically by reference numeral 40 in FIGS. 1 and 2, mounted in the boiler casing 12 above the liquid level L and positioned so that hot gases from the exhaust conduit 22 (which are in turbulent flow) pass through the heat transfer surface 40 into direct contact with liquid wetting the solid material heat transfer surface 40, thereby resulting in further heat exchange.

The solid material heat transfer surface 40 may comprise any conventional material that provides a large surface area and can be wetted, while allowing gas flow therethrough. For example open cell foams, such as of refractory material, or honeycomb structures or meshes of almost any type material, may be utilized. It is particularly desirable if the solid material heat transfer surface 40 includes pieces of limestone or another material which is capable of neutralizing the pH of the liquid contacted by the hot gases. Normally the liquid will become slightly acidic from contact with the hot gases, and since limestone is highly alkaline it will neutralize the pH, typically so that the condensate drained from the drain 29 has a pH of between about 7–8. However if there is an unusual circumstance where the liquid becomes too alkaline, the heat transfer surface 40 may be of a slightly acidic material. In one particularly effective embodiment, irregular pieces of limestone 41 are supported on a perforated plate 42, the plate 42 being of corrosion resistant metal, temperature resistant rigid plastic, or any other suitable material.

Any suitable means may be provided for maintaining the heat transfer surface 40 wetted so as to affect high efficiency heat exchange. For example liquid from an external source, or recirculated, may be dribbled onto the surface 40 from external and peripheral conduits, or from a perforated tray mounted above at least several different portions of the surface 40. In the preferred embodiment illustrated in the drawings, wetting is accomplished utilizing one or more spray nozzles 44 (e.g. of brass) which are connected to the discharge conduit 45 from the heat exchanger 37 that contains the condensate from the pool 27. The conduit 45 may be copper outside casing 12, and type 304 stainless steel within it.

The spray from the nozzles 44 may be directed directly onto substantially all of the surface 40, or partially against interior side walls of the boiler casing 12, or in any other suitable manner. The liquid moves downwardly under the force of gravity after spraying, and passes through the heat transfer surface 40, and then also falls down by gravity into the liquid pool 27. While some heat transfer between the liquid and the hot gases does take place, especially in view of the turbulence of the gases and if the liquid is sprayed by the spray nozzles 44, in both the gas volume 47 below the heat transfer surface 40, and in the gas volume 48 above the heat transfer surface 40 by contact between the liquid and the gas, a significant part of the heat transfer occurs in the heat transfer surface 40. Where a particularly large volume of gas is provided, or for other purposes, the heat transfer surface 40 may comprise a plurality of vertically spaced and/or staggered heat transfer surface elements.

In the preferred embodiment of the invention, rather than allowing the gases to merely exhaust due to their heat causing them to rise, it is desirable to provide a small vacuum (e.g. on the order of about three inches of water) within the boiler casing 12 at least when the burner 11 is operating. This may be provided by a conventional exhaust blower 50 which is connected to a gas conduit 51 extending upwardly from the top 24 of the boiler casing 12, the gases ultimately being exhausted through the exhaust blower 50 to a chimney 53 (e.g. of PVC exhaust pipe) or the like. In order to maximize the heat recovery it is also desirable to have a secondary heat exchanger, shown schematically at 52 in FIGS. 1 and 2, in the conduit 50. The heat exchanger 52 is preferably a conventional gas-to-gas heat exchanger with a second heat transfer fluid, typically air, passing therethrough, either by natural convection, or preferably forced, e.g. by a conventional blower 54. The heated gas (air) exiting the discharge conduit 55 from the heat exchanger 52 may also be used for space heating purposes, or may be supplied as the combustion air in conduit 19 to the burner 11, and/or may be used for any other desired uses.

Figure 3:
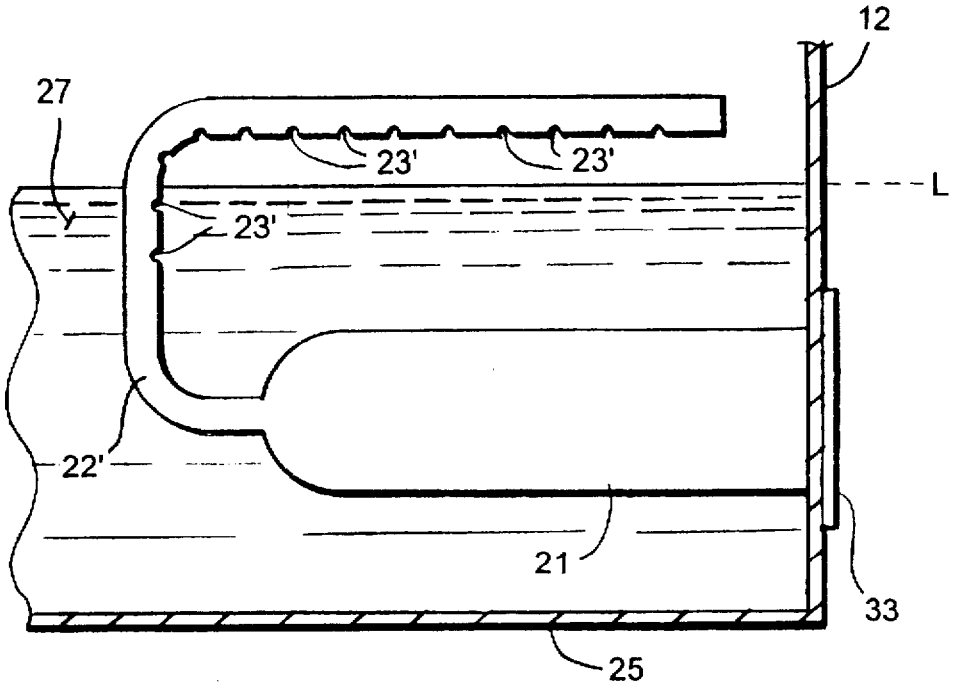
FIG. 3 is a detail side view, partly in cross-section and partly in elevation, of a different form of burner exhaust conduit than illustrated in the embodiment of FIGS. 1 and 2.

The embodiment of FIG. 3 provides a modification of the particular way in which the hot gases may be brought into direct contact with the liquid in the pool 27. In FIG. 3 components the same as those in the FIGS. 1 and 2 embodiment are shown by the same reference numerals; those that are similar are shown by the same reference numerals followed by a "'". The only significant difference between the embodiment of FIG. 3 and that of FIG. 2 is that the exhaust conduit 22' and the openings 23' therein are different. In the FIG. 3 embodiment preferably the openings 23' are all above the level L, with hot gas issuing therefrom moving downwardly into contact with the liquid in the pool 27. One or more openings 23' may be provided below the level L in the conduit 22' but only if a suitable check valve is provided in the submerged openings 23' to prevent liquid from the pool 27 leaking into the burner casing 21.

Utilizing the apparatus of FIGS. 1 through 3, a method of transforming the heat of combustion from a burner 11 into useful heat in a high efficiency manner is provided. The steps of the method may include: (a) Effecting combustion of fuel from line 16 and oxygen (such as combustion air) in line 19 in the burner 11 to produce hot gases 15. (b) Directing the hot gases 15 into direct contact with a pool 27 of liquid (e.g. by issuing the hot gases through the opening 23 submerged in the pool 27, or through openings 23' above the pool 27) to effect heat exchange between the hot gases 15 and the liquid in the pool 27. (c) Causing the hot gases 15 to flow in a turbulent manner into contact with a solid material heat transfer surface 40 wet with liquid (e.g. from spray nozzles 44) so that heat from the turbulent flow of hot gases is transferred directly to the liquid wetting the surface 40. (d) Ultimately passing the gases after steps (b) and (c) to exhaust 51 (e.g. by using the exhaust blower 50). And, (e) passing the liquid (in pool 27) heated during the practice of steps (b) and (c) into heat exchange relationship with a heat exchange fluid 14 which recovers usable heat from the liquid. Step (c) may be simultaneously practiced to neutralize the pH of the liquid wetting the heat transfer surface 40, e.g. where pieces of limestone 41 mounted on the perforated plate 42 are provided. The partial vacuum created by the exhaust blower 50 may not only exhaust the gases, but cause them to pass through a secondary heat exchanger 52 in heat transfer relationship with a second heat transfer fluid (e.g. air blown by blower 54).

While depending upon the dimensions of the components, the fuel utilized, the particular use for the useful heat recovered, and the like, there may be a wide variety of different temperatures, flow rates, or the like, according to one exemplary embodiment of the invention the liquid withdrawn in conduit 36 during operation of the burner 11 has a temperature of about 140° F., which temperature is lowered to about 130° F. after passage through the heat exchanger 37 into the conduit 45. The "cold" water 14 if from a baseboard heating system may have a temperature of about 125° F., which is increased to about 135° F. in conduit 39 after passing through the heat exchanger 37. The outside air entering the blower 54 is at ambient temperature, e.g. about 30°, and typically has its temperature raised about 60° by the secondary heat exchanger 52, e.g. to about 90° F. if originally at about 30° F.

When operation of the unit 10 is initiated, conventional off-the-shelf electronic controls are provided to initiate operation of the components in a desired sequence. Normally it is desirable to start the blower 50 a few seconds before the burner 11 and the pumps 35 and 38 are started, and to start the burner 11 and the pumps 35 and 38 substantially simultaneously.

While the volumes and flow rates will vary greatly depending upon the particular circumstances, one particular way in which sufficient surface area and volume of water are provided in order to effect high efficiency heat exchange, in an economical manner, is to provide as the total interior volume of the casing 12 a volume of between about six to twelve (6–12) cubic feet, e.g. about eight cubic feet. The normal flow rate of liquid through the pump 35 is about ten gallons per minute, and the normal flow rate of gas through regulator 17 is about 110 MBH, and the volume of liquid in the pool 27 is between about 10–20 gallons, preferably about 15 gallons. The gas first passes into the volume 47 below the heat transfer surface 40, and then passes through that surface 40 into the volume 48, while the liquid sprayed from the nozzles 44 passes downwardly to the surface 40, wetting it, and then drips down into the pool 27.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of transforming the heat of combustion from a burner into useful heat comprising the steps of:

(a) effecting combustion of fuel and oxygen in a burner to produce hot gases;

(b) directing the hot gases into direct contact with a pool of liquid so as to effect heat exchange between the hot gases and the liquid in the pool;

(c) causing the hot gases to flow in a turbulent manner into contact with a solid material heat transfer surface wet with liquid, so that heat from the turbulent flow of hot gases is transferred directly to the liquid wetting the solid material heat transfer surface, the solid material heat transfer surface being separate from a burner casing;

(d) ultimately passing the gases, after steps (b) and (c), to exhaust; and (e) passing the liquid heated during the practice of steps (b) and (c) into heat exchange relationship with a heat exchange fluid which recovers usable heat from the liquid.

2. A method as recited in claim 1 wherein step (c) is simultaneously practiced to neutralize the pH of the liquid wetting the heat transfer surface.

3. A method as recited in claim 2 wherein the liquid utilized in the practice of steps (b) and (c) is substantially exclusively condensate formed by the condensation of vapor in the hot gases from step (a).

4. A method as recited in claim 1 comprising the further step of causing the liquid heated during the practice of step (c) to flow into the pool of liquid, and wherein step (e) is practiced by causing the liquid from the pool of liquid to flow into heat exchange relationship with the heat exchange fluid.

5. A method as recited in claim 4 comprising the further step of (f) wetting the heat transfer surface by spraying liquid from step (e) onto the heat transfer surface after the liquid has passed into heat exchange relationship with the heat exchange fluid.

6. A method as recited in claim 1 comprising the further step of passing the gas, after the practice of steps (b) and (c), and before step (d), through a secondary heat exchanger in heat transfer relationship with a second heat transfer fluid.

7. A method as recited in claim 3 comprising the further step of removing formed condensate from the pool so that the pool stays within a predetermined size range.

8. A method as recited in claim 1 wherein step (b) is practiced by introducing the hot gases substantially completely within the pool liquid.

9. A method as recited in claim 1 wherein step (b) is practiced by introducing at least the majority of the hot gases into contact with the pool from above the pool.

10. A method as recited in claim 1 wherein step (c) is practiced at least in part by creating a partial vacuum which causes the hot gases to flow from the burner through the heat transfer surface and ultimately to exhaust.

11. A method of transforming the heat of combustion from a burner into useful heat comprising the steps of:

(a) effecting combustion of fuel and oxygen in a burner to produce hot gases;

(b) causing the hot gases to flow in a turbulent manner into contact with a solid material heat transfer surface wet with liquid, so that heat from the turbulent flow of hot gases is transferred directly to the liquid wetting the solid material heat transfer surface, while simultaneously neutralizing the pH of the liquid wetting the solid material heat transfer surface;

(c) ultimately passing the gases, after step (b), to exhaust and through a secondary heat exchanger in heat transfer relationship with a heat transfer fluid; and (d) passing the liquid heated during the practice of step (b) into heat exchange relationship with a heat exchange fluid which recovers usable heat from the liquid.

12. A method as recited in claim 11 wherein step (b) is practiced by passing the hot gases into contact with porous solid limestone as the heat transfer surface.

13. A method as recited in claim 11 comprising the further step of (f) wetting the heat transfer surface by spraying liquid from step (d) onto the heat transfer surface after the liquid has passed into heat exchange relationship with the heat exchange fluid.

14. A high efficiency boiler comprising:

a burner for combusting fuel with oxygen to produce hot gases;

a substantially water-tight burner casing surrounding said burner, and an exhaust conduit from said substantially water-tight casing, said exhaust conduit having an exhaust opening;

a boiler casing having a top and bottom, said boiler casing substantially water and air-tight;

liquid disposed within said boiler casing having a level spaced from the bottom of said boiler casing;

said burner casing disposed within said boiler casing, substantially submerged in said liquid, and said exhaust conduit opening positioned to direct the hot gases from said burner into direct contact with said liquid; and means for circulating liquid from said pool of liquid into heat exchange relationship with a heat exchange fluid so as to recover useful heat from said liquid.

15. A boiler as recited in claim 14 further comprising a solid material wet heat transfer surface mounted in said boiler casing above said liquid level and positioned so that turbulent hot gases from said exhaust conduit pass through said heat transfer surface into direct contact with liquid wetting said solid material heat transfer surface.

16. A boiler as recited in claim 15 further comprising at least one spray nozzle disposed in said boiler casing above said solid material heat transfer surface for spraying liquid onto said heat transfer surface to wet it.

17. A boiler as recited in claim 16 wherein said means for circulating liquid from said pool into heat exchange relationship with a heat transfer fluid comprises a conduit for connecting said liquid to said at least one spray nozzle after said liquid has been brought into heat exchange relationship with a heat transfer fluid.

18. A boiler as recited in claim 16 further comprising an exhaust blower and a secondary heat exchanger mounted adjacent said top of said boiler casing for exhausting gases from said burner cooled within said boiler casing, and passing those gases into heat exchange relationship with a second heat exchange fluid.

19. A boiler as recited in claim 15 wherein said solid material heat transfer surface includes pieces of limestone.

20. A boiler as recited in claim 14 wherein the liquid within said boiler casing is substantially exclusively condensate formed by condensation of vapors in the hot gases; and further comprising a drain establishing said liquid level and for draining excess condensate from said boiler casing.

21. A boiler as recited in claim 14 wherein said exhaust opening is disposed substantially completely below said liquid level.

22. A boiler as recited in claim 14 wherein said exhaust opening comprises a plurality of exhaust openings, at least the majority of said exhaust openings disposed above said liquid level.

23. A high efficiency boiler comprising:

a burner for combusting fuel and oxygen to produce hot gases;

an exhaust conduit, including an exhaust opening, for transmitting hot gases from said burner;

a boiler casing including a top and a bottom;

a wet heat transfer surface disposed in said boiler casing and substantially dividing said boiler casing into first and second volumes, said exhaust conduit opening into said first volume;

means for wetting said heat transfer surface so that hot gases from said exhaust opening come into direct contact with liquid on said heat transfer surface;

means for circulating liquid heated by hot gases within said boiler casing into heat exchange relationship with a heat exchange fluid exterior of said boiler casing so as to recover useful heat from said liquid; and means for causing the hot gases from said exhaust conduit to flow in a turbulent manner through said heat transfer surface from said first volume to said second volume.

24. A boiler as recited in claim 23 wherein said heat transfer surface extends substantially horizontally within said boiler casing, said first volume below said heat transfer surface and said second volume above said heat transfer surface.

25. A boiler as recited in claim 24 wherein said heat transfer surface includes limestone.

26. A boiler as recited in claim 25 wherein said heat transfer surface comprises pieces of limestone mounted on a perforated plate.

* * * * *